US009310729B2

(12) United States Patent
Ishida

(10) Patent No.: US 9,310,729 B2
(45) Date of Patent: Apr. 12, 2016

(54) FIXING DEVICE

(71) Applicant: Brother Kogyo Kabushiki Kaisha, Nagoya-shi, Aichi-ken (JP)

(72) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,100

(22) Filed: Sep. 30, 2014

(65) Prior Publication Data

US 2015/0093162 A1 Apr. 2, 2015

(30) Foreign Application Priority Data

Sep. 30, 2013 (JP) ..... 2013-204759

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS

| | | | | |
|---|---|---|---|---|
| 3,811,828 | A * | 5/1974 | Ohta | G03G 15/2007 101/467 |
| 5,499,087 | A * | 3/1996 | Hiraoka et al. | 399/329 |
| 8,150,304 | B2 * | 4/2012 | Kagawa et al. | 399/329 |
| 8,428,499 | B2 * | 4/2013 | Shinshi | 399/329 |
| 8,676,102 | B2 * | 3/2014 | Hiramatsu | 399/329 |
| 2011/0158718 | A1 | 6/2011 | Fujiwara et al. | |

FOREIGN PATENT DOCUMENTS

JP 2011-095534 A 5/2011

* cited by examiner

*Primary Examiner* — Clayton E Laballe
*Assistant Examiner* — Linda B Smith
(74) *Attorney, Agent, or Firm* — Banner & Witcoff, Ltd.

(57) ABSTRACT

A fixing device includes a heating element extending in a first direction and configured to generate heat, a nip member extending along the heating element in the first direction and configured to receive radiant heat from the heating element, an endless belt extending along the heating element in the first direction, a backup member extending along the heating element in the first direction, and an adhesive. The endless belt is configured to rotate. The endless belt surrounds the heating element and the nip member. The backup member nips the endless belt in cooperation with the nip member. The adhesive is disposed between the heating element and the nip member and fixes the heating element and the nip member relative to each other.

15 Claims, 6 Drawing Sheets

FIXING DEVICE

CROSS-REFERENCE TO RELATED APPLICATION

This application claims priority from Japanese Patent Application No. 2013-204759 filed on Sep. 30, 2013, which is incorporated herein by reference in its entirety.

FIELD OF DISCLOSURE

The disclosure relates to a fixing device configured to thermally fix a developing agent image transferred to a sheet.

BACKGROUND

A known fixing device includes an endless fixing belt, a heating element disposed inside the fixing belt, a nip member disposed inside the fixing belt, and a pressure roller disposed facing the fixing belt such that the pressure roller and the nip member hold the fixing belt therebetween. More specifically, in the fixing device, each end of the heating element is supported by a member (e.g., a member different from the nip member) disposed at each end of the fixing belt. A certain distance is provided between the heating element and the nip member.

In the fixing device, air between the heating element and the nip member, and the member supporting the heating element take the heat from the heating element. Therefore, improvements are required to heat the nip member promptly.

SUMMARY

The disclosure relates to a fixing device in which a nip member may be heated promptly.

According to an aspect of the disclosure, a fixing device may include a heating element, a nip member, an endless belt, a backup member, and an adhesive. The heating element extends in a first direction and configured to generate heat. The nip member extends along the heating element in the first direction and configured to receive radiant heat from the heating element. The endless belt extends along the heating element in the first direction. The endless belt is configured to rotate. The endless belt surrounds the heating element and the nip member. The backup member extends along the heating element in the first direction. The backup member nips the endless belt in cooperation with the nip member. The adhesive is disposed between the heating element and the nip member and fixes the heating element and the nip member relative to each other.

With this structure, heat from the heating element may be transmitted to the nip member via the adhesive, and thus the nip member may be heated promptly.

According to another aspect of the disclosure, a fixing device may include a heating element, a nip member, an endless belt, a backup member, a particular holding member, and a particular adhesive. The heating element extends in a first direction and configured to generate heat. The nip member extends along the heating element in the first direction and faces the heating element in a second direction perpendicular to the first direction. The nip member is configured to receive radiant heat from the heating element. The endless belt extends along the heating element in the first direction. The endless belt is configured to rotate. The endless belt surrounds the heating element and the nip member. The backup member extends along the heating element in the first direction. The backup member nips the endless belt in cooperation with the nip member. The particular holding member holds the heating element. The particular adhesive is disposed between the nip member and the particular holding member and fixes the nip member and the particular holding member relative to each other.

With this structure, heat from the heating element may be transmitted to the nip member via the particular adhesive disposed between the nip member and the particular holding member, and thus the nip member may be heated promptly.

BRIEF DESCRIPTION OF THE DRAWINGS

Reference now is made to the following description taken in connection with the accompanying drawings.

DETAILED DESCRIPTION

Illustrative embodiments will be described referring to the accompanying drawings.

In the following description, the expressions "front", "rear", "top or upper (up)", "bottom or lower (down)", "right", and "left" are used to define the various parts when a laser printer 1 is disposed in an orientation in which it is intended to be used.

Figure 1:
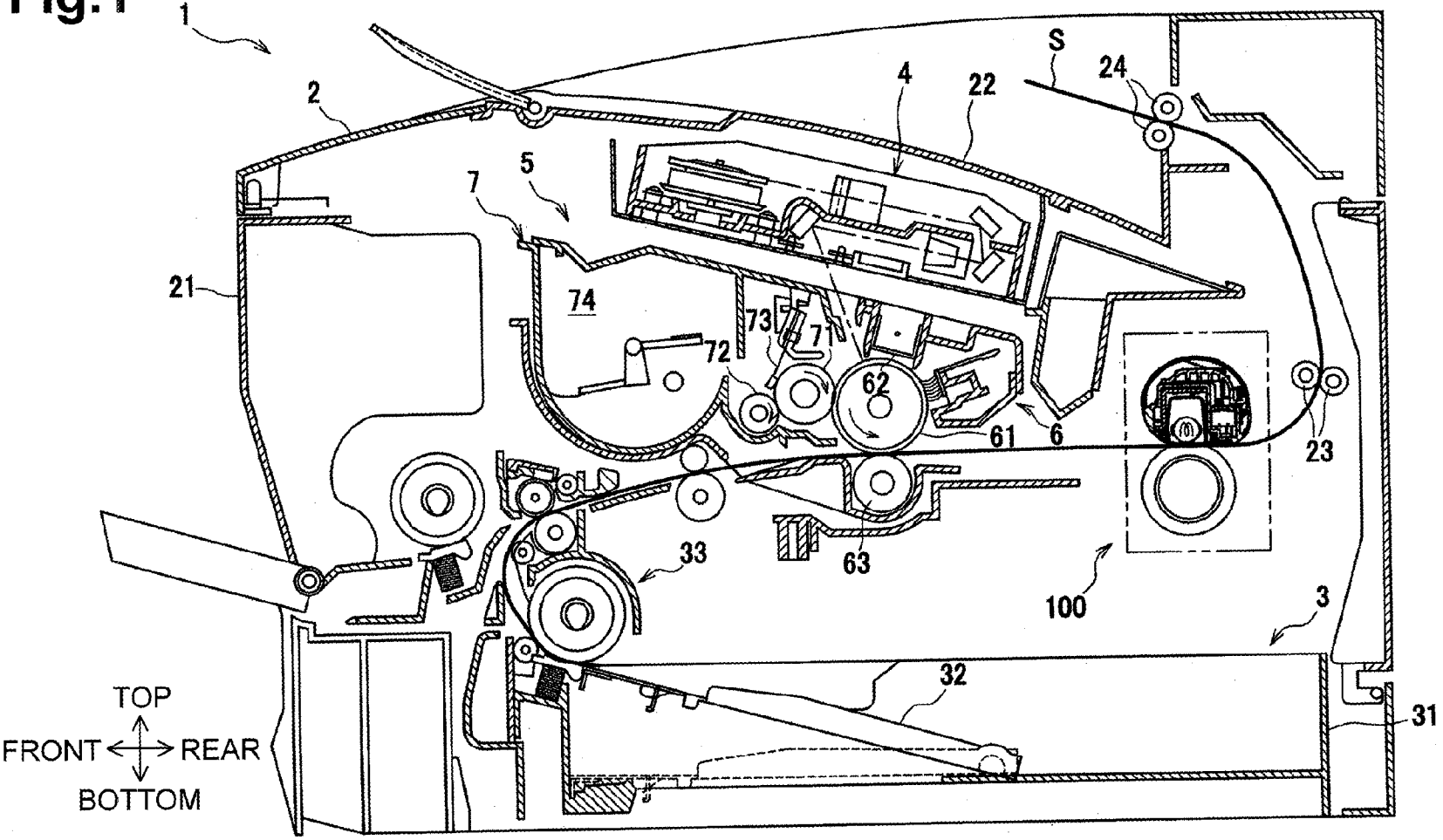
FIG. 1 is a schematic diagram of a laser printer comprising a fixing device in an illustrative embodiment according to one or more aspects of the disclosure.

As depicted in FIG. 1, the laser printer 1 may comprise a housing 2, in which a sheet feed unit 3 configured to feed a sheet S, an exposure device 4, a process cartridge 5 configured to transfer a toner image to the sheet S, and a fixing device 100 configured to thermally fix the toner image on the sheet S may be disposed.

The sheet feed unit 3 may be disposed at a lower portion of the housing 2. The sheet feed unit 3 may comprise a feed tray 31, a sheet lifting plate 32, and a sheet feeding mechanism 33. The sheets S accommodated in the feed tray 31 may be raised by the sheet lifting plate 32 and may be supplied by the sheet feeding mechanism 33 toward the process cartridge 5 (e.g., between a photosensitive drum 61 and a transfer roller 63).

The exposure device 4 may be disposed at an upper portion of the housing 2. The exposure unit 4 may comprise a laser light emitting unit (not shown), as well as a polygon mirror, lenses, and a reflecting mirrors, which are depicted without reference numerals. In the exposure device 4, laser light (see the dash-dot line) emitted from the laser light emitting unit based on image data may scan at high speed across the surface of the photosensitive drum 61 to expose the surface of the photosensitive drum 61 to light.

The process cartridge 5 may be disposed below the exposure device 4. The process cartridge 5 may be configured to be removably attached to the housing 2 through an opening exposed when a front cover 21 attached to the housing 2 is opened. The process cartridge 5 may comprise a drum unit 6 and a developing unit 7.

The drum unit 6 may comprise the photosensitive drum 61, a charger 62, and the transfer roller 63. The developing unit 7 may be configured to be removably attached to the drum unit 6. The developing unit 7 may comprise a developing roller 71, a supply roller 72, a thickness-regulation blade 73, and a toner storage 74 configure to store a developing agent, e.g., toner.

In the process cartridge 5, the surface of the photosensitive drum 61 may be uniformly charged by the charger 62. Thereafter, laser light from the exposure device 4 may scan at high speed across the surface of the photosensitive drum 61, and the surface of the photosensitive drum 61 may be exposed to light. An electrostatic latent image based on image data may be formed on the photosensitive drum 61. Toner in the toner storage 74 may be supplied through the supply roller 72 to the developing roller 71 and then may enter between the developing roller 71 and the blade 73. The toner may be carried on the developing roller 71 as a thin layer having a uniform thickness.

The toner carried on the developing roller 71 may be supplied from the developing roller 71 to the electrostatic latent image formed on the photosensitive drum 61. Thus, the electrostatic latent image may be visualized and a toner image may be formed on the photosensitive drum 61. Then, as the sheet S is conveyed between the photosensitive drum 61 and the transfer roller 63, the toner image on the photosensitive drum 61 may be transferred to the sheet S.

The fixing device 100 may be disposed behind the process cartridge 5. The toner image transferred to the sheet S may be thermally fixed to the sheet S while the sheet S passes through the fixing device 100. The sheet S on which the toner image has been thermally fixed may be discharged to a discharge tray 22 by feeding rollers 23 and 24.

Figure 2:
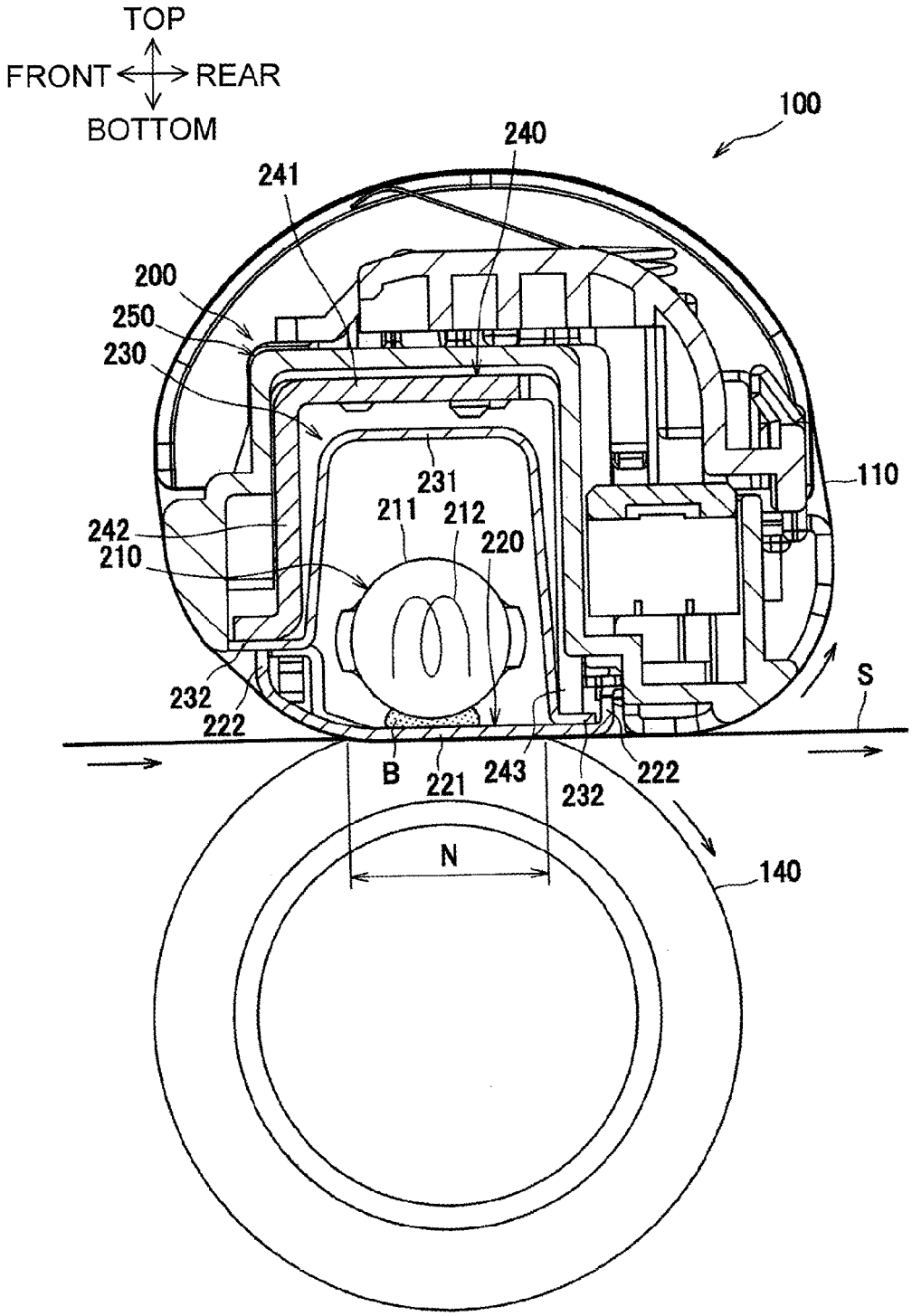
FIG. 2 is a cross-sectional view of the fixing device.

As depicted in FIG. 2, the fixing device 100 may comprise a rotatable, endless fixing belt 110, a heating unit 200 disposed inside the fixing belt 110 and configured to head the fixing belt 110, and a backup member, e.g., a pressure roller 140, that may nip the fixing belt 110 in cooperation with the heating unit 200.

The fixing belt 110 may be configured to be heated by the heating unit 200. The fixing belt 110 may have heat resistance and flexibility. The rotation of the fixing belt 110 may be guided by a guide member, which is depicted without a reference numeral.

The pressure roller 140 may be elastically deformable. The pressure roller 140 may be disposed below the fixing belt 110 and the heating unit 200. A nip portion N may be formed when the pressure roller 140 is elastically deformed and nips the fixing belt 110 in cooperation with the heating unit 200 (particularly, a nip plate 220). In the illustrative embodiment, the heating unit 200 and the pressure roller 140 may be mutually brought into pressure contact with each other while one of them is urged toward the other.

The pressure roller 140 may be configured to rotate with drive force transmitted from a motor (not depicted) disposed in the housing 2. As the pressure roller 140 rotates, the fixing belt 110 may be rotated by a frictional force exerted between the pressure roller 140 and the fixing belt 110 (or the sheet S). As the sheet S having the toner image transferred is conveyed rearward between the pressure roller 140 and the fixing belt 110 that has been heated, the toner image may be thermally fixed to the sheet S.

The heating unit 200 may be configured to apply heat to toner on the sheet S via the fixing belt 110. The heating unit 200 may comprise a heating element, e.g., a halogen lamp 210, a nip member, e.g., a nip plate 220, a reflective member 230, a stay 240, and a cover member 250.

Figure 3:
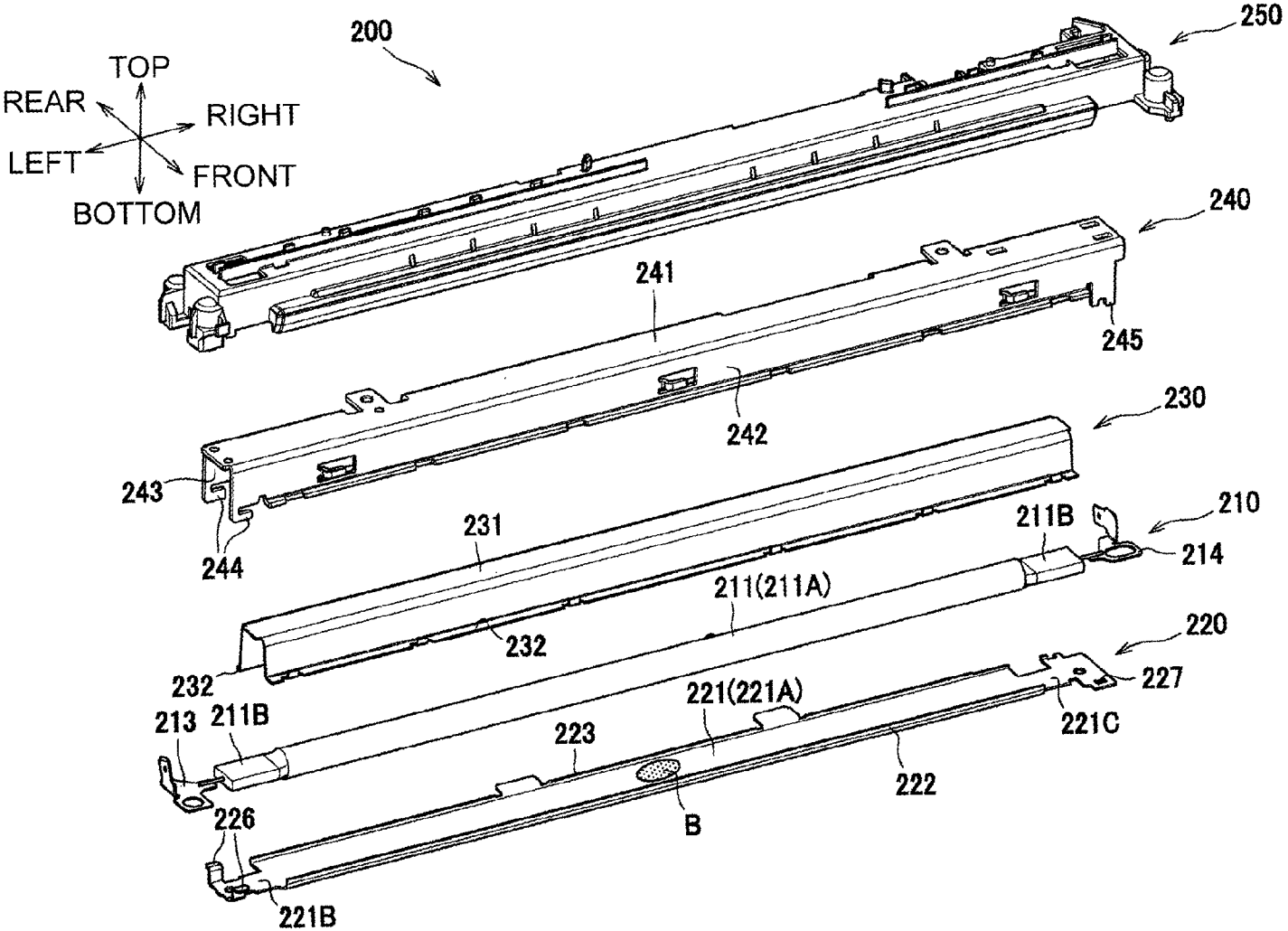
FIG. 3 is an exploded perspective view of a heating unit of the fixing device.

As depicted in FIGS. 2 and 3, the halogen lamp 210 may be a heater configured to generate heat with the application of electricity. The halogen lamp 210 may comprise a glass tube 211, a filament 212 provided in the glass tube 211, two terminals 213 and 214, each attached to a different end of the filament 212. The glass tube 211 may comprise a cylindrical portion 211A elongated along the left-right direction (e.g., a width direction of the fixing belt 110), and a sealed portion 211B integrally formed with the cylindrical portion 211A at each end of the cylindrical portion 211A. The sealed portion 211B may be formed into a flat plate shape. The sealed portion 211B may be formed smaller or thinner in the top-bottom direction than the cylindrical portion 211A, and greater or wider in the front-rear direction than the cylindrical portion 211A. The dimension of the sealed portion 211B in the top-bottom direction may be smaller than the dimension of the sealed portion 211B in the front-rear direction and the dimension of the sealed portion 211B in the left-right direction. The halogen lamp 210, e.g., a central portion of the cylindrical portion 211A in the left-right direction, may be fixed to a central portion of the nip plate 220 in the left-right direction, with the adhesive B.

More specifically, the halogen lamp 210 may have an adhesive region or area to which the adhesive B may be applied. The nip plate 220 may have an adhesive region or area to which the adhesive B may be applied. The adhesive B may be applied such that the adhesive B may be disposed between the halogen lamp 210 and the nip plate 220 to connect the adhesive region of the halogen lamp 210 and the adhesive region of the nip plate 220. A portion of the halogen lamp 210 other than its adhesive region may face a portion of the nip plate 220 other than its adhesive region with a slight distance in the top-bottom direction. When the distance is provided between the portion of the halogen lamp 210 other than its adhesive region and the portion of the nip plate 220 other than its adhesive region, the distance may be preferably within 1 mm, more preferably within 0.5 mm. In other words, the adhesive B disposed between the halogen lamp 210 and the nip plate 220 may have a thickness of, preferably, at most 1 mm, more preferably, at most 0.5 mm.

The disclosure is not limited thereto. The halogen lamp 210 may be fixed to the nip plate 220, by applying adhesive so as to extend across the halogen lamp 210 and the nip plate 220 in a state in which the halogen lamp 210 is made contact with the nip plate 220. Various types of adhesive may be used for the adhesive B. Preferably, adhesive having higher thermal conductivity than resin (e.g., resin forming the housing 2), e.g., ceramic adhesive, may be used.

The halogen lamp 210 fixed to the nip plate 220 with the adhesive B may be fixed to the cover member 250 by screws (not depicted) at each end of the halogen lamp 210 (specifically, at the terminals 213 and 214). More specifically, a screw hole formed on the left terminal 213 of the halogen lamp 210 may be round and may generally correspond to the diameter of the screw. A screw hole formed on the right terminal 214 may be elongated in the left-right direction.

The nip plate 220 may be a plate-shaped member configured to receive radiant heat from the halogen lamp 210. The nip plate 220 may be disposed to allow the lower surface of the nip plate 220 to make sliding contact with the inner peripheral surface of the fixing belt 110. The nip plate 220 may be formed by machining a material, e.g., an aluminum plate, having higher thermal conductivity than the steel stay 240 described later.

The nip plate 220 may comprise a generally plate-shaped main portion 221 extending perpendicular to the top-bottom direction, a curve portion 222 extending forwardly and upwardly, while curving, from the front end of the main portion 221, and a bent portion 223 bent to protrude upward from the rear end of the main portion 221. The main portion 221, the curve portion 222, and the bent portion 223 may be integrally formed.

The main portion 221 may be disposed below the halogen lamp 210 (e.g., the pressure roller 140 side). The main portion 221 may be formed longer than the glass tube 211 of the halogen lamp 210 in the left-right direction. More specifically, the main portion 221 may comprise a base portion 221A having substantially the same length as the cylindrical portion 211A of the glass tube 211, a first extending portion 221B extending leftward from the left end of the base portion 221A, and a second extending portion 221C extending rightward from the right end of the base portion 221A.

The base portion 221A may be formed such that a width thereof in the front-rear direction may be constant along the left-right direction.

The width of the first extending portion 221B in the front-rear direction may be smaller than that of the base portion 221A. A pair of the engagement portions 226 may be integrally formed with a left end portion of the first extending portion 221B. The engagement portions 226 may be configured to engage with relevant hook portions 244 disposed on left end portions of the stay 240.

The width of a left portion of the second extending portion 221C in the front-rear direction may be smaller than that of the base portion 221A. The width of a right portion of the second extending portion 221C in the front-rear direction may be greater than that of the left portion of the second extending portion 221C. The right portion of the second extending portion 221C may have an engagement opening 227 configured to engage and hold an engagement protrusion 245 disposed at a right end portion of the stay 240.

The reflective member 230 may be configured to reflect radiant heat (mainly emitted in the front-rear direction and in the upward direction) from the halogen lamp 210 toward the nip plate 220. The reflective member 230 may be disposed with a predetermined distance from the halogen lamp 210 to cover the halogen lamp 210.

As the reflective member 230 collects the radiant heat from the halogen lamp 210 to the nip plate 220, the radiant heat from the halogen lamp 210 may be efficiently used, and the nip plate 220 and the fixing belt 110 may be promptly heated.

Specifically, the reflective member 230 may be formed by bending, in a substantially U-shape, a material, e.g., an aluminum plate, having high infrared and far-infrared reflectance and higher thermal conductivity than the stay 240. More specifically, the reflective member 230 may comprise a reflective portion 231 having a curved shape, e.g., a substantially U-shape in cross-sectional view, and a flange portion 232 extending outward in the front-rear direction from each lower end of the reflective portion 231. The reflective member 230 may be formed thinner than the stay 240.

The stay 240 may be configured to support each end of the nip plate 220 in the front-rear direction from a side opposite from the pressure roller 140. The stay 240 may be configured to receive a force exerted from the pressure roller 140 to the nip plate 220. The stay 240 may be formed by bending a metal plate, e.g., a steel plate, having relatively high stiffness into a substantially U shape in cross-sectional view along the reflective member 230 (particularly, the reflective portion 231), so as to define an opening which may open toward the nip plate 220, as depicted in FIG. 2.

More specifically, the stay 240 may comprise an upper wall 241 disposed above the halogen lamp 210, as depicted in FIG. 2, and a front wall 242 and a rear wall 243 extending downward from the front and rear ends of the upper wall 241, respectively.

The front wall 242 may be disposed upstream of the halogen lamp 210 in the feeding direction of the sheet S. The lower end of the front wall 242 may sandwich, in cooperation with the nip plate 220, the flange portion 232 disposed on the front side of the reflective member 230. The front wall 242 may be configured to support the front end of the nip plate 220 from above.

The rear wall 243 may be disposed downstream of the halogen lamp 210 in the feeding direction of the sheet S. The lower end of the rear wall 243 may sandwich, in cooperation with the nip plate 220, the flange portion 232 disposed on the rear side of the reflective member 230. The rear wall 243 may be configured to support the rear end of the nip plate 220 from above.

The cover member 250 may be disposed outward of the stay 240 to cover the stay 240. The cover member 250 may have a substantially U-shape in cross-sectional view.

The following effects may be obtained in the illustrative embodiment. The halogen lamp 210 may be fixed to the nip plate 220 with the adhesive B. Heat from the halogen lamp 210 may be transmitted to the nip plate 220 via the adhesive B. Therefore, the nip plate 220 may be heated promptly. As the halogen lamp 210 is fixed to the nip plate 220 with the adhesive B, the halogen lamp 210 may be disposed closer to the nip plate 220. Accordingly, the nip plate 220 may be favorably heated by the heat emitted from a portion of the halogen lamp 210 other than its adhesive region as well.

The halogen lamp 210 may be fixed to a central portion of the nip plate 220 in the left-right direction. Therefore, the halogen lamp 210 and the nip plate 220 may be fixed in a balanced manner.

This disclosure is not limited to the above-described illustrative embodiment, but may be applied to, for example, the following embodiments. Like reference numerals denote like corresponding parts and detailed description thereof with respect to the following embodiments may be omitted herein.

Figure 4:
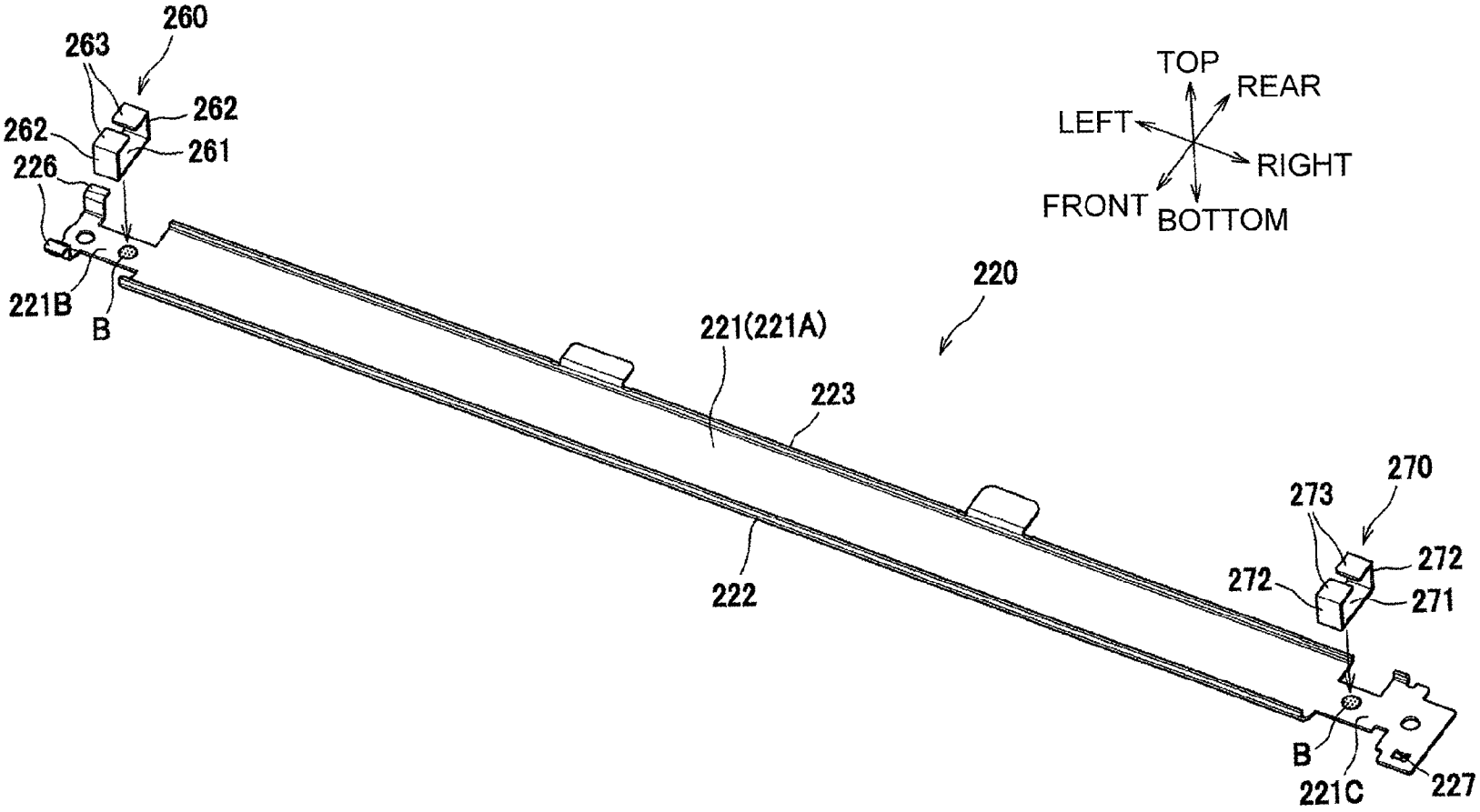
FIG. 4 is a perspective view of a modified nip plate of the heating unit, to which holding members configured to hold a halogen lamp of the heating unit are to be attached with adhesive.

In the above-described illustrative embodiment, the halogen lamp 210 may be fixed to the nip plate 220 with the adhesive B. However, the disclosure might not be limited thereto. For example, first and second holding members 260 and 270 configured to hold the halogen lamp 210, as depicted in FIG. 4, may be provided. Each holding member 260 and 270 may be attached to the nip plate 220 with the adhesive B. The halogen lamp 210 may be fixed to the nip plate 220 via the holding members 260 and 270. In this case, the adhesive B disposed between each holding member 260 and 270 and the nip member 210 may have a thickness of, preferably, at most 1 mm, more preferably at most 0.5 mm.

More specifically, the first holding member 260 may be disposed on a left end portion of the nip plate 220. The first holding member 260 may be configured to hold the left sealed portion 211B of the glass tube 211. The first holding member 260 may comprise a base 261, two first wall portions 262, and two second wall portions 263.

The base 261 may have a rectangular plate shape elongated in the front-rear direction. The base 261 may be a portion to be fixed to the nip plate 220, via the adhesive B.

Each first wall portion 262 may extend upward (e.g., opposite to the pressure roller 140) from the respective end of the base 261 in the front-rear direction (or the rotation direction of the fixing belt 110). Each first wall portion 262 may face the sealed portion 211B of the halogen lamp 210 in the front-rear direction. In other words, the first wall portion 262 may be disposed at each end portion of the nip plate 220 in the front-rear direction. Distance between the first wall portions 262 may be substantially the same as the width of the sealed portion 211B of the glass tube 211 in the front-rear direction. Thus, the sealed portion 211B may be held between the first wall portions 262.

Each second wall portion 263 may bend inwardly in the front-rear direction from the upper end of the respective first wall portion 262. Each second wall portion 263 may extend so as to come closer to each other. Each second wall portion 263 may face the base 261. Each second wall portion 263 may be configured to contact the sealed portion 211B of the glass tube 211, with the cylindrical portion 211A of the glass tube 211 contacting the base portion 221A of the nip plate 220. Thus, the halogen lamp 210 may be held by the second wall portions 263 and the base portion 221A. More specifically, the cylindrical portion 211A of the glass tube 211 may be supported by the base portion 221A, and the upper surface of the sealed portion 211B of the halogen lamp 210 may be held by the second wall portions 263.

The second holding member 270 may be disposed at a right end portion of the nip plate 220. The second holding member 270 may be configured to hold the right sealed portion 211B of the glass tube 211. More specifically, the second holding member 270 may comprise a base 271 similar to the base 261 of the first holding member 260, two first wall portions 272 similar to the first wall portions 262 of the first holding member 260, and two second wall portions 273 similar to the second wall portions 263 of the first holding member 260. The sealed portion 211B of the halogen lamp 210 may be held between the first wall portions 272. The halogen lamp 210 may be held between the second wall portions 273 and the base portion 221A. More specifically, the cylindrical portion 211A of the halogen lamp 210 may be supported by the base portion 221A. The upper surface the sealed portion 211B of the halogen lamp 210 may be held by the second wall portions 273.

Further, a holding force between the first wall portions 272 of the second holding member 270 may be smaller than a holding force between the first wall portions 262 of the first holding member 260. A holding force between the second wall portions 273 of the second holding member 270 and the base portion 221A may be smaller than a holding force between the second wall portions 263 of the first holding member 260 and the base portion 221A.

Thus, an end of the glass tube 211 of the halogen lamp 210 in the left-right direction may be held by the first holding member 260. The other end of the glass tube 211 of the halogen lamp 210 in the left-right direction may be held by the second holding member 270 so as to allow the movement of the halogen lamp 210 in the left-right direction.

The following effects may be obtained in the embodiment of FIG. 4.

Heat from the halogen lamp 210 may be transmitted to the nip plate 220 via the holding members 260 and 270 and the adhesive B. Therefore, the nip plate 220 may be heated promptly. In the embodiment of FIG. 4, the halogen lamp 210 may be disposed closer to the nip plate 220, so that the nip plate 220 may be heated promptly.

The holding members 260 and 270 may be disposed at respective ends of the halogen lamp 210. Therefore, the halogen lamp 210 may be stably held by the holding members 260 and 270. Heat from the halogen lamp 210 may be transmitted to the nip plate 220 via the holding members 260 and 270. Therefore, as compared with a case in which, for example, one, holding member is provided, the nip plate 220 may be heated more promptly.

One end of the halogen lamp 210 may be held by the first holding member 260, and the other end of the halogen lamp 210 may be held by the second holding member 270 so as to allow the movement of the halogen lamp 210 in the left-right direction. Therefore, thermal expansion of the halogen lamp 210 or the nip plate 220 in the left-right direction may be absorbed.

Each holding member 260 and 270 may be of any material. Each holding member 260 and 270 may be preferably made of a metal plate, e.g., an aluminum plate, or high thermal conductive resin having higher thermal conductivity than resin (e.g., resin forming the housing 2).

In the embodiment of FIG. 4, each holding member 260 and 270 may comprise one base 261 and 271, two first wall portions 262 and 272, and two second wall portions 263 and 273, respectively. However, the disclosure might not be limited thereto. For example, as depicted in FIG. 5, each holding member 260 and 270 may comprise one base 261 and 271, one first wall portion 262 and 272, and one second wall portion 263 and 273, respectively.

Figure 5:
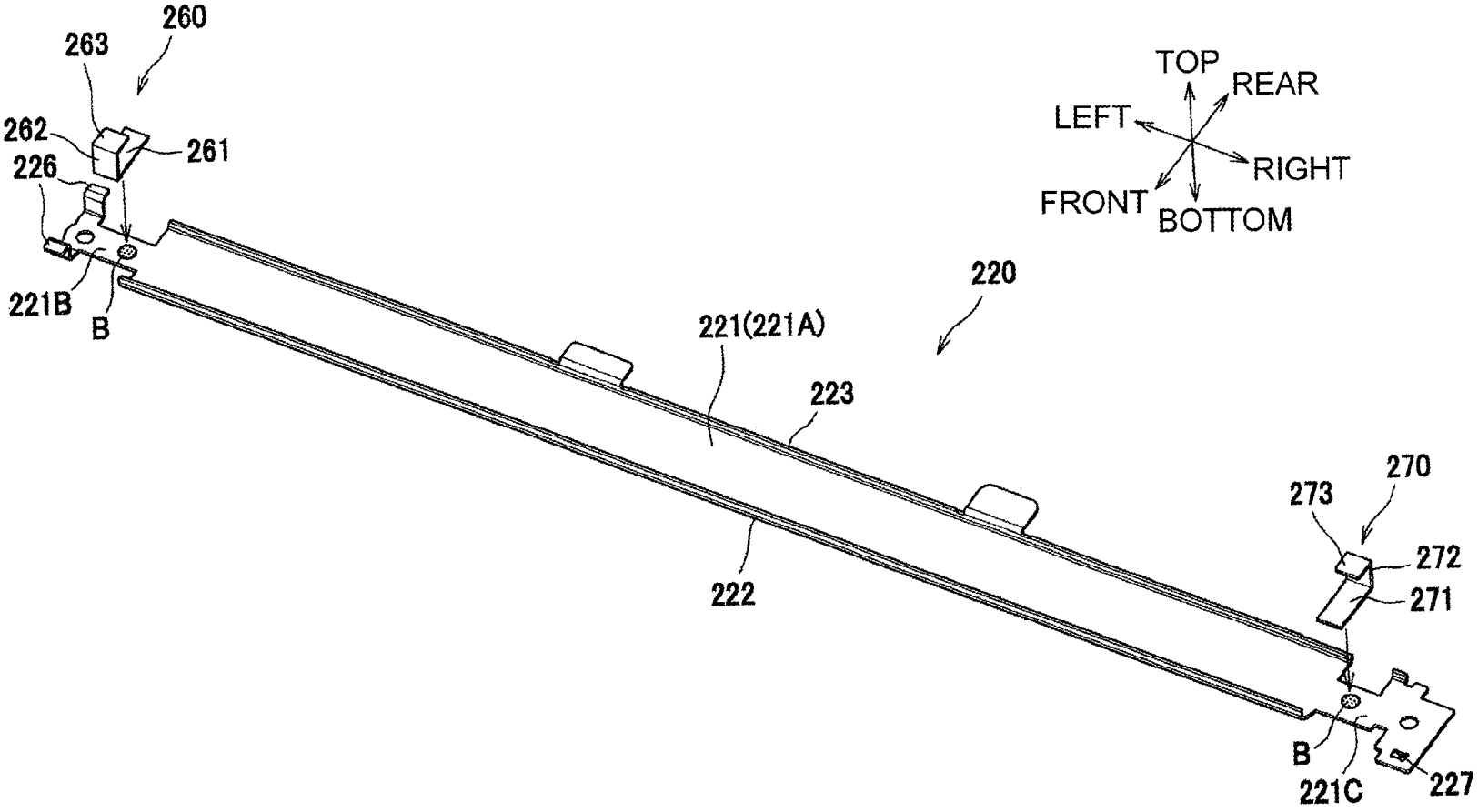
FIG. 5 is a perspective view of modified holding members.

More specifically, in the structure of FIG. 5, the first wall portion 262 of the first holding member 260 may be disposed at the front end of the base 261 (e.g., the upstream end in the rotation direction of the fixing belt 110) and may be disposed at a front end portion of the nip plate 220. The second wall portion 263 may extend rearward (e.g., toward the downstream side in the rotation direction of the fixing belt 110) from the first wall portion 262. The first wall portion 272 of the second holding member 270 may be disposed at the rear end of the base 271 (e.g., the downstream end in the rotation direction of the fixing belt 110) and may be disposed at a rear end portion of the nip plate 220. The second wall portion 273 may extend forward (e.g., toward the upstream side in the rotation direction of the fixing belt 110) from the first wall portion 272.

In this case also, each holding member 260 and 270 may favorably support the halogen lamp 210. Positions of the first holding member 260 and the second holding member 270 in the left-right direction might not be limited to those depicted in FIG. 5, but may be reversed.

Figure 6:
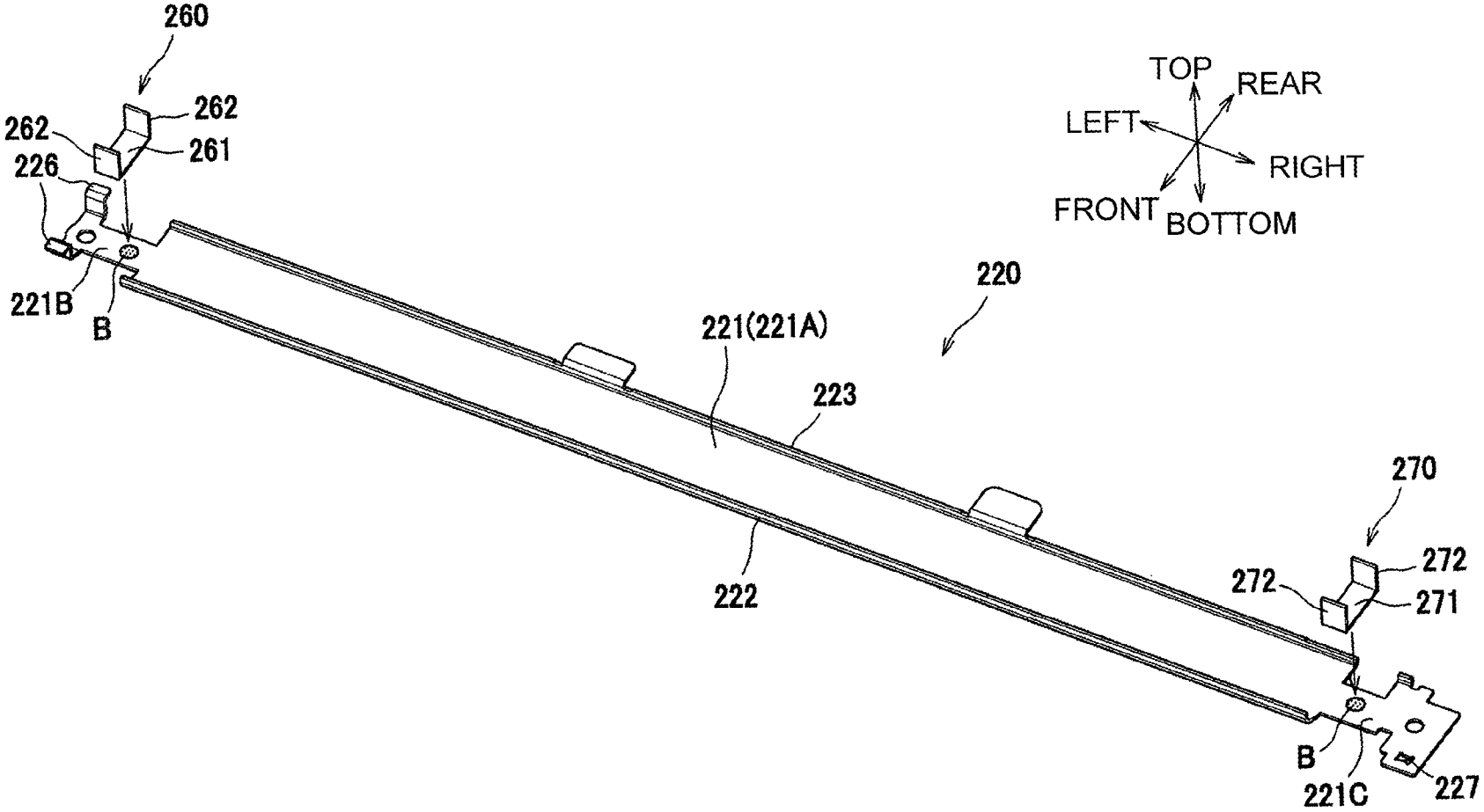
FIG. 6 is a perspective view of another modified holding members.

Further, as depicted in FIG. 6, each holding member 260 and 270 may comprise one base 261 and 271 and two first wall portions 262 and 272, respectively.

More specifically, in the structure depicted in FIG. 6, each first wall portion 262 and 272 may extend upward from the front and rear ends of the base 261 and 271 (e.g., the upstream and downstream ends in the rotation direction of the fixing belt 110), respectively. In this structure, the left and right sealed portions 211B of the halogen lamp 210 may be held between the first wall portions 262 and 272 of the holding member 260 and 270, respectively. In this case also, each holding member 260 and 270 may support the halogen lamp 210 favorably.

In the embodiments depicted in FIG. 4-6, each holding member 260 and 270 may comprise the base 261 and 271, respectively. However, the disclosure might not be limited thereto. For example, the first wall portions 262 and 272 may be fixed to the nip plate 220 with the adhesive without the base 261 and 271.

In each of the above-described illustrative embodiments, the halogen lamp 210 or the holding members 260 and 270 may be fixed to the nip plate 220 with the adhesive B. However, the disclosure might not be limited thereto. For example, the halogen lamp 210 may be fixed by welding. A position where the heating element (e.g. halogen lamp 210) and the nip member (e.g., the nip plate 220) may be attached by, for example, bonding or welding, might not be limited to the position depicted in each of the above-described illustrative embodiments, but may be any positions. A member fixing the heating element and the nip member by welding is also referred to as adhesive.

In each of the above-described illustrative embodiments, the halogen lamp 210 may be an example of the heating element. However, the disclosure might not be limited thereto. For example, the heating element may comprise a carbon heater.

In each of the above-described illustrative embodiments, the nip plate 220 may be an example of the nip member. However, the disclosure might not be limited thereto. The nip member may comprise, for example, a thick member that might not have a plate-like shape.

In the above-described illustrative embodiment, the pressure roller 140 may be an example of the backup member. However, the disclosure might not be limited thereto. The backup member may comprise, for example, a belt-like pressing member.

While the disclosure has been described in detail referring to the specific embodiments thereof, this is merely an example, and various changes, arrangements and modifications may be applied therein without departing from the spirit and scope of the disclosure.

What is claimed is:

1. A fixing device comprising:

a heating lamp extending in a first direction and configured to generate heat;

a nip member extending along the heating lamp in the first direction and configured to receive radiant heat from the heating lamp;

an endless belt extending along the heating lamp in the first direction and contacting a surface of the nip member opposite to the heating lamp, the endless belt being configured to rotate, the endless belt surrounding the heating lamp and the nip member;

a backup member extending along the heating lamp in the first direction, the backup member nipping the endless belt in cooperation with the nip member; and an adhesive disposed between the heating lamp and the nip member, the adhesive fixing the heating lamp and the nip member relative to each other such that the heating lamp is disposed at a distance corresponding to a thickness of the adhesive, relative to the nip member in a second direction orthogonal to the first direction.

2. The fixing device according to claim 1, wherein the adhesive is disposed at a central portion of the nip member in the first direction.

3. The fixing device according to claim 1, wherein the adhesive includes ceramic adhesive.

4. The fixing device according to claim 1, wherein the adhesive disposed between the heating lamp and the nip member has a thickness of at most 1 mm.

5. The fixing device according to claim 1, wherein the heating lamp is a halogen lamp.

6. The fixing device according to claim 4, wherein the adhesive disposed between the heating lamp and the nip member has a thickness of at most 0.5 mm.

7. A fixing device comprising:

a heating lamp extending in a first direction and configured to generate heat;

a nip member extending along the heating lamp in the first direction and facing the heating lamp in a second direction perpendicular to the first direction, the nip member being configured to receive radiant heat from the heating lamp;

an endless belt extending along the heating lamp in the first direction and contacting a surface of the nip member opposite to the heating lamp, the endless belt being configured to rotate, the endless belt surrounding the heating lamp and the nip member;

a backup member extending along the heating lamp in the first direction, the backup member nipping the endless belt in cooperation with the nip member;

a particular holding member holding the heating lamp; and a particular adhesive disposed between the nip member and the particular holding member holding the heat lamp and fixing the nip member and the particular holding member holding the heating lamp relative to each other.

8. The fixing device according to claim 7, wherein the particular adhesive is disposed between the particular holding member and an end portion of the nip member in the first direction.

9. The fixing device according to claim 7, wherein the particular holding member includes a particular wall portion facing in a third direction opposite to the second direction, and wherein the heating lamp is held by the particular wall portion of the particular holding member and the nip member.

10. The fixing device according to claim 7, wherein the particular holding member includes a particular wall portion extending in the second direction, and wherein the heating lamp is held by the particular wall portion of the particular holding member and the nip member.

11. The fixing device according to claim 7, wherein the particular adhesive includes ceramic adhesive.

12. The fixing device according to claim 7, wherein the particular adhesive disposed between the nip member and the particular holding member has a thickness of at most 1 mm.

13. The fixing device according to claim 7, further comprising:

a further holding member holding the heating lamp; and a further adhesive disposed between the nip member and the further holding member and fixing the nip member and the further holding member relative to each other, wherein the particular holding member is disposed at one end portion of the nip member in the first direction, and the further holding member is disposed at the other end of the nip member in the first direction.

14. The fixing device according to claim 7, wherein the heating lamp is a halogen lamp.

15. The fixing device according to claim 11, wherein the particular adhesive disposed between the nip member and the particular holding member has a thickness of at most 0.5 mm.

* * * * *